US007553997B2

(12) United States Patent
Stark et al.

(10) Patent No.: US 7,553,997 B2
(45) Date of Patent: Jun. 30, 2009

(54) HYDROGENATION OF OLEFINIC FEEDSTOCKS

(75) Inventors: Nicolaus Ladislaus Stark, Vereeniging (ZA); Josias Sevaas De Kock Swart, Randburg (ZA)

(73) Assignee: Catalytic Distillation Technologies, Pasadena, TX (US)

( * ) Notice: Subject to any disclaimer, the term of this patent is extended or adjusted under 35 U.S.C. 154(b) by 742 days.

(21) Appl. No.: 10/525,148

(22) PCT Filed: Aug. 21, 2003

(86) PCT No.: PCT/US03/26153

§ 371 (c)(1),
(2), (4) Date: Sep. 27, 2005

(87) PCT Pub. No.: WO2004/018390

PCT Pub. Date: Mar. 4, 2004

(65) Prior Publication Data

US 2006/0052652 A1 Mar. 9, 2006

(30) Foreign Application Priority Data

Aug. 22, 2002 (ZA) ..... 2002/6736

(51) Int. Cl.
*C07C 5/03* (2006.01)

(52) U.S. Cl. ..... 585/275; 585/271; 585/250

(58) Field of Classification Search ..... 585/275, 585/271, 250

See application file for complete search history.

(56) References Cited

U.S. PATENT DOCUMENTS

| | | | | |
|---|---|---|---|---|
| 5,087,780 | A | 2/1992 | Arganbright | 585/259 |
| 5,321,175 | A | 6/1994 | Antonio Barrio Calle et al. | |
| 5,449,501 | A * | 9/1995 | Luebke et al. | 422/193 |
| 5,595,634 | A | 1/1997 | Hearn et al. | 203/29 |
| 5,877,363 | A | 3/1999 | Gildert et al. | 585/260 |
| 6,083,378 | A | 7/2000 | Gildert et al. | 208/209 |
| 6,169,218 | B1 | 1/2001 | Hearn et al. | 585/260 |
| 6,284,104 | B1 | 9/2001 | Maraschino | 202/154 |
| 6,416,658 | B1 | 7/2002 | Maraschino et al. | 208/189 |
| 6,576,588 | B2 | 6/2003 | Ryu et al. | 502/331 |
| 2001/0016672 | A1 | 8/2001 | Maraschino | |
| 2003/0230516 | A1 | 12/2003 | Johnson et al. | 208/208 R |

FOREIGN PATENT DOCUMENTS

WO 01/14501 3/2001

OTHER PUBLICATIONS

Office Action in Mexico Application No. PA/a/2005/001854 PTC/US2003/026153 dated Jan. 21, 2009 6 pages.

* cited by examiner

*Primary Examiner*—Thuan Dinh Dang
(74) *Attorney, Agent, or Firm*—Osha • Liang LLP

(57) ABSTRACT

A process for bulk hydrogenation of an olefin-containing feedstock containing a plurality of different unsaturated olefinic hydrocarbon compounds, for example a feedstock containing from 60 to 100 mass % unsaturated olefinic hydrocarbon compounds, by subjecting the olefinic feedstock to bulk hydrogenation in a catalytic distillation zone containing a hydrogenation catalyst, and in the presence of hydrogen, under conditions favoring bulk hydrogenation to hydrogenate unsaturated olefinic hydrocarbon compounds present in the feedstock into their corresponding saturated compounds, and withdrawing the saturated compounds from the catalytic distillation zone.

9 Claims, 1 Drawing Sheet

HYDROGENATION OF OLEFINIC FEEDSTOCKS

BACKGROUND OF THE INVENTION

Field of the Invention

This invention relates to the hydrogenation of olefinic feedstocks. In particular, it relates to a process for hydrogenating an olefinic feedstock containing a plurality of different unsaturated olefinic hydrocarbon compounds.

SUMMARY OF THE INVENTION

According to the invention, there is provided a process for hydrogenating an olefin-containing feedstock containing a plurality of different unsaturated olefinic hydrocarbon compounds, the process including: subjecting the olefinic feedstock to bulk hydrogenation by means of catalytic distillation in a catalytic distillation zone containing a hydrogenation catalyst, and in the presence of hydrogen, thereby to hydrogenate unsaturated olefinic hydrocarbon compounds present in the feedstock into their corresponding saturated compounds; and withdrawing the saturated compounds from the catalytic distillation zone.

The catalytic distillation in the catalytic distillation zone involves effecting hydrogenation reactions, under the influence of the hydrogenation catalyst, simultaneously with, or in combination with, distillation in the same zone. In other words, hydrogenation and separation by means of distillation, are effected simultaneously in a single zone.

By 'bulk hydrogenation' is meant that a number of different unsaturated olefinic hydrocarbon compounds, that are present in the olefinic feedstock, are hydrogenated. In one embodiment of the invention, substantially all the unsaturated olefinic hydrocarbon compounds in the feedstock may be hydrogenated. The process may then include feeding the saturated compounds into a separation stage, and separating lighter saturated compounds or paraffins from heavier saturated compounds or paraffins.

In another embodiment of the invention, however, the number of different unsaturated olefinic hydrocarbon compounds that are hydrogenated may be less than the total number of different unsaturated olefinic hydrocarbon compounds present in the feedstock. The process may then include withdrawing at least one unreacted unsaturated olefinic hydrocarbon compound from the catalytic distillation zone.

DETAILED DESCRIPTION OF THE INVENTION

Figure 1:
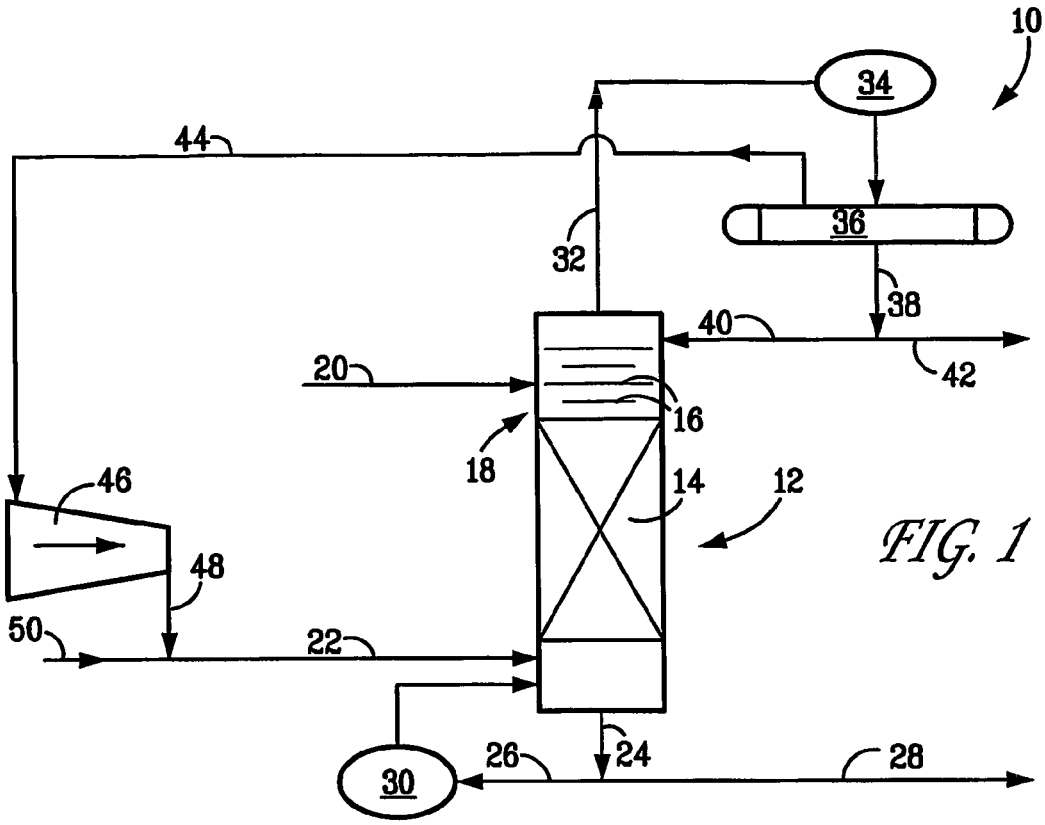
FIG. 1 shows a simplified flow diagram of a process for hydrogenating an olefinic feedstock, according to a first embodiment of the invention.

The invention is thus characterized thereby that, by means of the bulk hydrogenation, a number of different hydrocarbon compounds are hydrogenated, rather than only a single unsaturated hydrocarbon compound or a single category of unsaturated hydrocarbon compounds, such as dienes and/or acetylenic compounds, being hydrogenated.

The feedstock may comprise from 60% by mass to 100% by mass unsaturated olefinic hydrocarbon compounds, typically from 80% to 100% by mass of such compounds. When the feedstock comprises less than 100% by mass of unsaturated olefinic hydrocarbon compounds, the balance of the feedstock may typically be made up of branched and normal paraffins such as octane and/or 2-methyl heptane; oxygenates such as alcohols; aromatics such as benzene; and saturated and unsaturated cyclic compounds other than aromatics, such as cyclohexene. Any aromatic compounds present in the feedstock will be hydrogenated to the corresponding saturated cyclic compounds; however, any oxygenated compounds present in the feedstock will not normally be hydrogenated during the bulk hydrogenation of the feedstock.

In one embodiment of the invention, the feedstock may be a $C_7$-$C_{13}$ naphtha feedstock, i.e., it may contain a range of different unsaturated olefinic hydrocarbon compounds having from 7 to 13 carbon atoms. However, in another embodiment of the invention, the feedstock may comprise oligomers obtained from $C_3$-$C_7$ unsaturated olefinic hydrocarbons, i.e., it may contain a range of different unsaturated olefinic oligomers.

The feedstock may be Fischer-Tropsch derived, i.e., it may be obtained from the so-called Fischer-Tropsch process. In other words, it may be obtained by reacting a synthesis gas comprising carbon monoxide and hydrogen in the presence of a suitable Fischer-Tropsch catalyst, normally a cobalt, iron, or cobalt/iron Fischer-Tropsch catalyst, at elevated temperature in a suitable reactor, which is normally a fixed or slurry bed reactor, thereby to obtain a range of products, including a range of olefinic or unsaturated hydrocarbon compounds suitable for use as the feedstock in this invention. The products from the Fischer-Tropsch process must then usually be worked up to obtain the olefinic feedstock. Thus, as hereinbefore described, the feedstock will then normally contain, in addition to the unsaturated olefinic hydrocarbon compounds, also branched and normal paraffins such as octane and/or 2-methyl heptane; oxygenates such as alcohols; aromatics such as benzene; and saturated and unsaturated cyclic compounds other than aromatics, such as cyclohexene.

From 30% to about 100% of the unsaturated olefinic hydrocarbon compounds may be hydrogenated in the catalytic distillation zone.

While a single unsaturated olefinic hydrocarbon compound may, at least in principle, remain unhydrogenated or unreacted in the catalytic distillation zone, two or more different unsaturated olefinic hydrocarbon compounds will normally remain unhydrogenated or unreacted. These unreacted or unhydrogenated compounds are usually either the lightest compounds in the feedstock or the heaviest compounds in the feedstock, with the process of the invention thus resulting in these compounds being separated, in the catalytic distillation zone, from the hydrogenated compounds.

The catalytic distillation zone is typically provided by a column. The catalyst may be in particulate form, and may be provided in the form of a packed bed. The feedstock and the hydrogen will then naturally be fed continuously into the column, with the product being withdrawn continuously from the column as a product stream. The feedstock and hydrogen may enter the column at about the same level, or at different levels. Preferably, however, the hydrogen may enter the column at a level below the level at which the feedstock enters the column. Suitable distillation media, e.g., random packing, structured packing, trays or any other distillation apparatus or equipment, are provided in the column below and/or above the catalyst bed.

The particulate hydrogenation catalyst in the packed bed permits good contact between the unsaturated olefinic hydrocarbon compounds and the hydrogen, while also providing the required separation between gas and liquid phases. The hydrogenation catalyst may, in particular, be a heterogeneous catalyst. It typically has a particle size of 0.79 mm to 6.35 mm, and may be of any desired shape, e.g., spherical, elongate or the like. Typically, such catalysts contain one or more metals such as nickel, copper, cobalt, chromium, zinc, iron and the platinum group metals, i.e., platinum, palladium, rhodium and ruthenium, as their active component.

While the column can, at least in principle, operate at an elevated pressure of up to 1500 kPa(g), it is envisaged that it will normally operate at about atmospheric pressure or at only slightly above atmospheric pressure, which is an advantage of the process according to the invention. Thus, the operating pressure in the column may typically be in the range of about 50 kPa(g) to about 200 kPa(g).

The temperature in the column will be dependent on, among others, the feedstock composition, the column pressure and the unsaturated olefinic hydrocarbon compounds which are not to be hydrogenated, i.e., which are to be separated from the hydrogenated compounds. Thus, when the feedstock is the $C_7$-$C_{13}$ naphtha feedstock, and the column operating pressure is 100 kPa(g)-200 kPa(g), the catalyst bed temperature may be about 120° C.-140° C., with the product stream then being removed as a bottoms stream and the unreacted unsaturated olefinic hydrocarbon compounds being lighter compounds which are removed as an overheads stream. When the feedstock is the $C_7$-$C_{13}$ naphtha feedstock, and the column operating pressure is about 100 kPa(g), the catalyst bed temperature may be about 150° C., with the product stream being removed as an overheads stream and the unreacted unsaturated olefinic hydrocarbon compounds being heavier compounds which are removed as a bottoms stream. When the feedstock comprises unsaturated olefinic oligomers derived from $C_3$-$C_7$ olefins, and the column operating pressure is about 50 kPa(g)-200 kPa(g), the catalyst bed temperature may be about 160° C.-200° C., with the product stream being removed as an overheads stream and the unreacted unsaturated hydrocarbon compounds being heavier compounds which are removed as a bottoms stream.

The invention will now be described by way of example with reference to the accompanying drawings.

Referring to FIG. 1, reference numeral 10 generally indicates a process for hydrogenating an olefinic feedstock, according to a first embodiment of the invention.

The process 10 includes a catalytic distillation column 12 containing a packed bed 14 of a particulate hydrogenation catalyst as well as a plurality of distillation plates 16 in a distillation region 20 above the packed catalyst bed 14.

A feedstock feed line 20 leads into the distillation region 18, while a hydrogen feed line 22 leads into the column 12 below the packed catalyst bed 14.

A bottoms withdrawal line 24 leads from the bottom of the column 12. It splits into a reboil line 26 and a product withdrawal line 28. The line 26 is fitted with a reboiler 30, and returns to the bottom portion of the column 12.

An overheads line 32 leads from the top of the column 12 to a condenser 34 and from there to a reflux drum 36. A liquids line 38 leads from the reflux drum 36, and splits into a return line 40 to the top of the column 12 and an overheads product withdrawal line 42. A hydrogen withdrawal line 44 leads from the reflux drum 36 to a hydrogen recycle compressor 46, with a line 48 leading from the compressor 46 to the hydrogen feed line 22. A hydrogen make-up line 50 also leads into the hydrogen feed line 22.

In use, an olefinic feedstock, such as a Fischer-Tropsch derived naphtha feedstock, is fed into the distillation region 18 along the feed line 20, while hydrogen is simultaneously fed into the bottom of the column along the line 22. The column 12 is maintained at slightly above atmospheric pressure, typically at 100 kPa(g) 200 kPa(g), with the catalyst bed temperature typically being controlled at 120° C.-165° C. Heavier unsaturated olefinic hydrocarbon compounds in the Fischer-Tropsch naphtha feedstock are hydrogenated to paraffins, with these paraffins being withdrawn along the line 24 as a bottoms stream or product. Some of the bottoms product is reboiled via the line 26 and the reboiler 30, with the remainder thereof being withdrawn along the line 28. Lighter unreacted or unhydrogenated unsaturated olefinic hydrocarbon products are withdrawn through the line 32 and condensed in the condenser 34 before passing to the reflux drum 36. A liquid component thereof is withdrawn along the line 38 with a portion thereof being refluxed along the line 40 to the top of the column 12 while the remainder is withdrawn as an overheads product or stream along the line 42. Hydrogen is recycled as feed to the column by means of the line 44 leading from the reflux drum 36, the compressor 46 and the line 48.

By means of the process 10, bulk hydrogenation of a Fischer-Tropsch derived naphtha feedstock can thus be effected. In this bulk hydrogenation, heavier unsaturated olefinic hydrocarbon compounds are hydrogenated to paraffins which are withdrawn along the line 28 as the bottoms product. Unwanted lighter unsaturated olefinic hydrocarbon compounds are withdrawn along the line 42 as the overheads product.

It will be appreciated that other feedstocks can be treated in a process having the same configuration as in FIG. 1.

Thus, in another version of this embodiment of the invention, the process 10 can be used for bulk hydrogenation of olefinic feedstock comprising unsaturated olefinic oligomers (i.e., polymers made up of 2, 3 or 4 monomer units) derived from $C_3$-$C_7$ olefins. The unsaturated oligomers are hydrogenated to paraffins, with the paraffins being withdrawn as the bottoms product, and with unwanted light unhydrogenated or unsaturated olefinic oligomers and olefins being removed as the overheads product.

In the process 10, the degree of hydrogenation is determined by the supply of hydrogen along the line 22, and the operating conditions of the column 12. Hydrogenation does not necessarily have to be complete. The hydrogen recycle compressor 46 ensures adequate hydrogen partial pressures in the catalyst bed 14.

The process 10 is exemplified in Examples 1 and 2 hereunder. In Examples 1 and 2, as well as in Examples 3 and 4 also described hereunder, a 10 meter 2 inch (approximately 5 cm) diameter catalytic distillation column 12, consisting of four 2.5 m sections, was used. In each of Examples 1 to 4, the column was loaded with a commercially available hydrogenation catalyst as specified. The particulate catalyst was packed in pockets made from woven stainless steel mesh wrapped in demister wire. The column had feed points on an upper flange of all the 2.5 m sections, to allow for process optimization. The hydrogenated compounds could be removed as either an overheads product stream or a bottoms product stream.

Generally, in Examples 1 and 2 hereunder, the process configuration was as indicated in FIG. 1 except that the hydrogen recycle lines 44, 48 and the hydrogen compressor 46 were omitted. Instead, a hydrogen purge line led from the reflux drum 36. No distillation plates were provided either above or below the catalyst bed and the catalyst packing thus also fulfilled the roll of distillation plates.

Generally, in Examples 1 and 2, a $C_7$-$C_{13}$ Fischer-Tropsch derived naphtha feedstock, with an olefin content of about 84 mass %, was fed above the catalyst bed 14, at a rate of 0.5-1 kg/h. Hydrogen was fed into the bottom of the column 12 along the line 22, i.e., below the catalyst bed 14, at a rate of 1.0-2.5 m3n/hour. The column pressure was varied between 100-200 kPa(g) which resulted in catalyst bed temperatures ranging from 120° C.-140° C. The conversion of the olefins in the feedstock was about 60-80%. The hydrogenated compounds were removed as a bottoms stream.

It was found that similar results to those obtained in Examples 1 and 2 could also be achieved using a larger scale catalytic distillation column 12 also having a length of 10 m but having a 4 inch (about 100 mm) diameter, and using the same commercially available hydrogenation catalyst.

Example 1

The 10 meter 2 inch column was loaded with a commercially available hydrogenation catalyst obtainable from Kata Leuna GmbH Catalysts of Am Haupttor, Geb 8322, D-06237 Leuna, Germany, under the designation Leuna-Catalyst 6564TL 1.2. A $C_7$-$C_{13}$ Fischer-Tropsch derived naphtha feedstock with an olefin content of between 42 and 72 mass % was fed above the catalyst bed at a rate of 1 kg/hr. The feedstock composition is given in Table 1.1.

TABLE 1.1

Hydrocarbon Feedstock composition and Feed Characterization.

| | Mass % |
|---|---|
| Feed component | |
| C5 | 0.23 |
| C6 | 2.18 |
| C7 | 17.78 |
| C8 | 27.39 |
| C9 | 23.78 |
| C10 | 17.49 |
| C11 | 9.46 |
| >C11 | 1.69 |
| Total | 100 |
| Feed Characterization | |
| Bromine no. (g Br/100 g) | 81.6 |
| Acid no. (mg KOH/g) | 15.4 |
| Carbonyls (% MEK) | 5.9 |
| Alcohols (% $C_7$) | 6.5 |
| Esters (mg KOH/g) | 2.3 |

Hydrogen was fed below the catalyst bed at a rate of 89 g/hr. The column pressure was 100 kPa(g) which resulted in a catalyst bed temperature of 117° C. The reboiler temperature was 164° C. The hydrogenated compounds were removed as the bottoms stream. 798 g of bottoms product and 200 g of overheads product were collected per hour. The conversion of the olefins in the feedstock was 57%. The analyses of the overheads and bottoms products are given in Table 1.2 below.

TABLE 1.2

Product analyses

| | |
|---|---|
| Overheads | |
| Bromine no. (g Br/100 g) | 15.77 |
| Acid no. (mg KOH/g) | 18.90 |
| Carbonyls (% MEK) | 6.30 |
| Alcohols (% $C_7$) | 10.50 |
| Esters (mg KOH/g) | 2.20 |

TABLE 1.2-continued

Product analyses

| | |
|---|---|
| Bottoms (Hydrogenated product) | |
| Bromine no. (g Br/100 g) | 40.25 |
| Acid no. (mgKOH/g) | 5.90 |
| Carbonyls (% MEK) | 4.50 |
| Alcohols (% C7) | 3.10 |
| Esters (mg KOH/g) | 10.30 |

Example 2

The 10 meter 2 inch column was loaded with the same commercially available hydrogenation catalyst as used in Example 1. The same Fischer-Tropsch derived feedstock as used in Example 1, was fed above the catalyst bed at a rate of 748 g/hr.

Hydrogen was fed below the catalyst bed at a rate of 224 g/hr. The column pressure was 212 kPa(g) which resulted in a catalyst bed temperature of 140° C. The reboiler temperature was 197° C. The hydrogenated products were removed as the bottoms stream. 544 g of bottoms product and 216 g of overheads product were collected per hour. The conversion of the olefins in the feed stream was 78%. The analyses of the overheads and bottoms products are given in Table 2.1 below.

TABLE 2.1

Product analyses

| | |
|---|---|
| Overheads | |
| Bromine no. (g Br/100 g) | 10.25 |
| Acid no. (mg KOH/g) | 19.40 |
| Carbonyls (% MEK) | 3.60 |
| Alcohols (% $C_7$) | 14.80 |
| Esters (mg KOH/g) | 2.40 |
| Bottoms (Hydrogenated product) | |
| Bromine no. (g Br/100 g) | 20.82 |
| Acid no. (mg KOH/g) | 1.50 |
| Carbonyls (% MEK) | 2.70 |
| Alcohols (% $C_7$) | 4.10 |
| Esters (mg KOH/g) | 18.30 |

Figure 2:
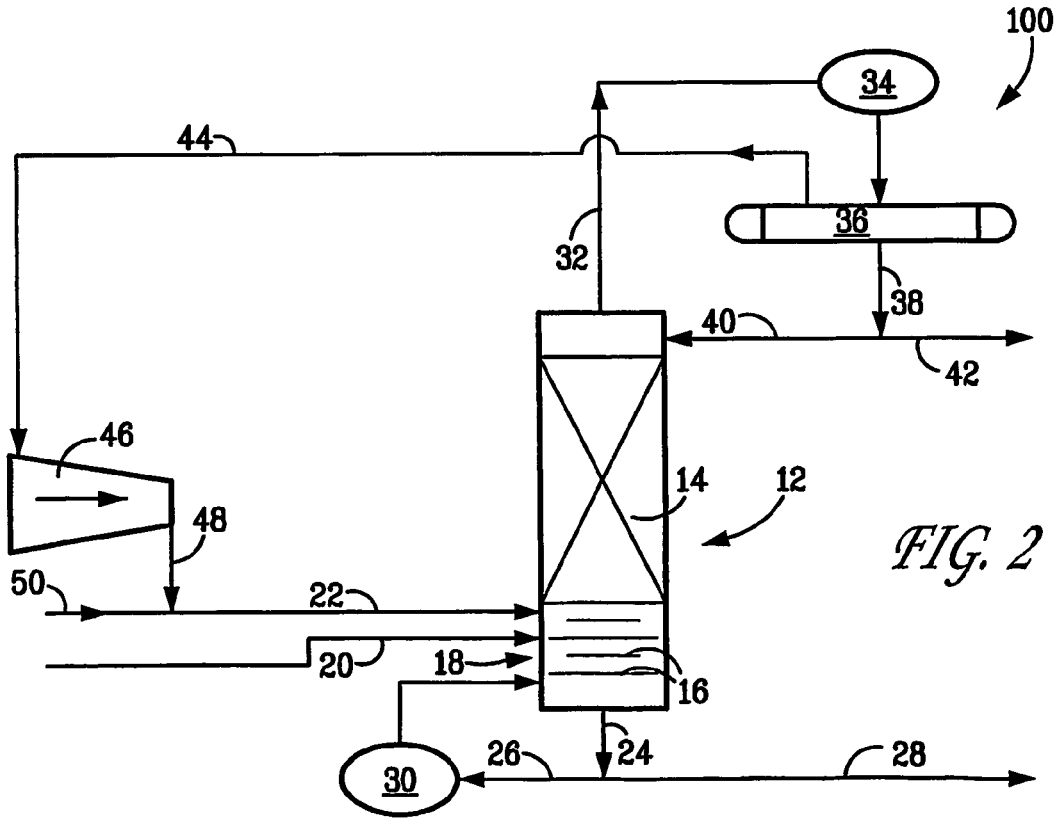
FIG. 2 shows a simplified flow diagram of a process for hydrogenating an olefinic feedstock, according to a second embodiment of the invention.

Referring to FIG. 2, reference numeral 100 generally indicates a process for hydrogenating an olefinic feedstock, according to a second embodiment of the invention.

In the process 100, components which are the same or similar to those of the process 10 of FIG. 1, are indicated with the same reference numerals.

The catalytic distillation column 12 of the process 100 is similar to that of the process 10, except that its distillation region 18 is provided below the packed catalyst bed 14. The feedstock feed line 20 still leads into the distillation zone 18, and it is thus also located below the packed catalyst bed 14.

In the process 100, bulk hydrogenation of an olefinic feedstock, such as a Fischer-Tropsch derived naphtha feedstock can be effected, with unsaturated hydrocarbon compounds in the feedstock being converted to paraffins. The hydrogenated compounds, i.e. the paraffins, are withdrawn along the line 42 as an overheads product, with unwanted heavier unsaturated hydrocarbon compounds, i.e. feed oligomers, being removed along the line 28 as a bottoms product.

It will be appreciated that other feedstocks can be treated in a process having the same configuration as in FIG. 2.

Thus, in another version of this embodiment of the invention, hydrogenation of a mixture of oligomers derived from $C_3$-$C_7$ unsaturated or olefinic hydrocarbon compounds, can be hydrogenated in the process 100. The unsaturated oligomers are hydrogenated to paraffins. The paraffins were withdrawn as an overheads product, with unwanted unsaturated heavier components, in the form of heavier olefins and/oroligomers, were removed as a bottoms product. As before, the degree of hydrogenation is determined by the supply of hydrogen and the operating conditions in the catalytic distillation column 12, and the hydrogenation does not necessarily have to be complete. The hydrogen recycle compressor 46 ensures adequate hydrogen partial pressures in the packed bed 14 of the catalytic distillation column 12.

As in FIG. 1, the degree of hydrogenation is determined by the supply of hydrogen and the operating conditions in the column 14; the hydrogenation does not necessarily have to be complete; and the hydrogen recycle compressor 46 ensures adequate hydrogen partial pressures in the catalyst bed 14.

In Examples 3 to 9 hereunder, the process 100 was used save that, instead of the hydrogen recycle along the line 44, the compressor 46 and the line 48, a hydrogen purge from the reflux drum 36 was used.

Generally, in Examples 3 and 4, a $C_7$-$C_{13}$ Fischer-Tropsch naphtha feedstock with an olefin content of 84 mass % was fed into the catalytic distillation column 12 below the catalyst bed 14, at a rate of 2 kg/h. Hydrogen was fed into the column 14 at a rate of 2 $m^3$n/hour, below the catalyst bed 14. The column pressure was maintained at 100 kPa(g) which resulted in catalyst bed temperatures of about 150° C. The conversion of olefins in the feedstock was 80%-85%.

Example 3

The 10 meter 2 inch column was loaded with the same commercially available hydrogenation catalyst as used in Example 1. A $C_7$-$C_{13}$ Fischer-Tropsch naphtha feedstock with an olefin content of between 42 and 72 mass % was fed below the catalyst bed at a rate of 2 kg/hr. The feed composition is given in Table 3.1.

TABLE 3.1

Hydrocarbon Feedstock composition and Feed Characterization.

| | Mass % |
|---|---|
| Feed component | |
| C8 | 1.00 |
| C9 | 49.43 |
| C10 | 33.13 |
| C11 | 15.73 |
| C12 | 0.71 |
| >C12 | 0.00 |
| Total | 100 |
| Feed Characterization | |
| Bromine no. (g Br/100 g) | 82.5 |
| Acid no. (mg KOH/g) | 0.2 |
| Carbonyls (% MEK) | 5.9 |
| Alcohols (% C7) | 6.2 |
| Esters (mg KOH/g) | 2.6 |

Hydrogen was fed below the catalyst bed at a rate of 179 g/hr. The column pressure was 100 kPa(g) which resulted in catalyst bed temperature of 143° C. The reboiler temperature was 219° C. The reflux ratio was maintained at 2. The hydrogenated compounds were removed as the overheads stream. 486 g of bottoms product and 1.497 kg of overheads product were collected per hour. Excess hydrogen was flared. The conversion of the olefins in the feedstock was 83%. The analyses of the overheads and bottoms products are given in Table 3.2 below.

TABLE 3.2

Product analyses

| Overheads (Hydrogenated product) | |
|---|---|
| Bromine no. (g Br/100 g) | 3.25 |
| Acid no. (mgKOH/g) | 0.02 |
| Carbonyls (% MEK) | 5.05 |
| Alcohols (% C7) | 5.70 |
| Esters (mg KOH/g) | 2.50 |
| Bottoms Bromine no. (g Br/100 g) | 47.18 |
| Acid no. (mgKOH/g) | 0.09 |
| Carbonyls (% MEK) | 3.85 |
| Alcohols (% C7) | 1.85 |
| Esters (mg KOH/g) | 4.50 |

Example 4

The 10 meter 2 inch column was loaded with the same commercially available hydrogenation catalyst as used in Example 1. The same Fischer-Tropsch feedstock as used in Example 3 was fed below the catalyst bed at a rate of 2 kg/hr.

Hydrogen was fed below the catalyst bed at a rate of 179 g/hr. The column pressure was 100 kPa(g) which resulted in catalyst bed temperature of 148° C. The reboiler temperature was 236° C. The reflux ratio was maintained at 2. The hydrogenated compounds were removed as the overheads stream. 102 g of bottoms product and 1.897 kg of overheads product were collected per hour. Excess hydrogen was flared. The conversion of the olefins in the feed stream was 75%. The analyses of the overhead and bottom products are given in Table 4.1 below.

TABLE 4.1

Product analyses

| Overheads (Hydrogenated product) | |
|---|---|
| Bromine no. (g Br/100 g) | 20.14 |
| Acid no. (mgKOH/g) | 0.11 |
| Carbonyls (% MEK) | 5.60 |
| Alcohols (% C7) | 5.70 |
| Esters (mg KOH/g) | 2.25 |
| Bottoms Bromine no. (g Br/100 g) | 21.83 |
| Acid no. (mgKOH/g) | 0.13 |
| Carbonyls (% MEK) | 4.95 |
| Alcohols (% $C_7$) | 0.40 |
| Esters (mg KOH/g) | 5.45 |

In Examples 5 to 9, a 10 meter 4 inch (approximately 100 mm) diameter catalytic distillation column 12, consisting of 10 1 m sections, was used. In each of the Examples, it was loaded with a packed bed 14 of commercially available hydrogenation catalyst as specified. The catalyst was packed in proprietary catalyst packing obtainable from Catalytic Distillation Technologies of 10100 Bay Area Boulevard, Pasadena, Tex. 77507, United States of America, and described in U.S. Pat. No. 5,942,456. The column had feed points on an upper flange of all the 1 m sections, to allow for process optimization. The hydrogenated compounds were removed as a bottoms stream.

Example 5

The 10 meter 4 inch column was loaded with a commercially available hydrogenation catalyst obtainable from Kata Leuna Catalysts of Am Haupttor, Geb 8322, D-06237 Leuna, Germany under the designation Leuna-Catalyst 7762K. A $C_7$-$C_{13}$ Fischer-Tropsch derived naphtha feedstock with an olefin content of between 45 and 80 mass % was fed below the catalyst bed at a rate of 14.251 kg/hr. The feed composition is given in Table 5.1.

TABLE 5.1

| Hydrocarbon Feedstock composition and Feed Characterization. | Mass % |
|---|---|
| Feed component | |
| C6 | 0.42 |
| C7 | 15.73 |
| C8 | 27.48 |
| C9 | 24.50 |
| C10 | 17.68 |
| C11 | 11.30 |
| C12 | 2.03 |
| >C12 | 0.06 |
| Total | 100 |
| Feed Characterization | |
| Bromine no. (g Br/100 g) | 90.0 |
| Acid no. (mg KOH/g) | 17.2 |
| Carbonyls (% MEK) | 6.4 |
| Alcohols (% $C_7$) | 6.3 |
| Esters (mg KOH/g) | 4.3 |

Hydrogen was fed below the catalyst bed at a rate of 396 g/hr. The column pressure was 102 kPa(g) which resulted in catalyst bed temperature of 172° C. The reboiler temperature was 203° C. The reflux ratio was maintained at 6. The hydrogenated compounds were removed as the overhead stream. 2.789 kg of bottoms product and 11.463 kg of overheads product were collected per hour. Excess hydrogen was flared. The conversion of the olefins in the feedstock was 87%. The analyses of the overheads and bottoms products are given in Table 5.2 below.

TABLE 5.2

| Product analyses | |
|---|---|
| Overheads (Hydrogenated product) | |
| Bromine no. (g Br/100 g) | 10.12 |
| Acid no. (mg KOH/g) | 16.30 |
| Carbonyls (% MEK) | 5.30 |
| Alcohols (% $C_7$) | 6.80 |
| Esters (mg KOH/g) | 3.70 |
| Bottoms | |
| Bromine no. (g Br/100 g) | 17.55 |
| Acid no. (mg KOH/g) | 1.30 |
| Carbonyls (% MEK) | 3.00 |
| Alcohols (% $C_7$) | 0.60 |
| Esters (mg KOH/g) | 32.00 |

Example 6

The 10 meter 4 inch column was loaded with the same commercially available hydrogenation catalyst as was used in Example 5. The same Fischer-Tropsch derived naphtha feedstock as used in Example 5 was fed below the catalyst bed at a rate of 18.016 kg/hr.

Hydrogen was fed below the catalyst bed at a rate of 434 g/hr. The column pressure was 300 kPa(g) which resulted in catalyst bed temperature of 208° C. The reboiler temperature was 244° C. The reflux ratio was maintained at 4. The hydrogenated compounds, i.e. paraffins, were removed as the overhead stream. 2.727 kg of bottoms and 15.648 kg of overheads were collected per hour. Excess hydrogen was flared. The conversion of the olefins in the feed stream was 95%. The analyses of the overhead and bottom products are given in Table 6.1 below.

TABLE 6.1

| Product analyses | |
|---|---|
| Overheads (Hydrogenated product) | |
| Bromine no. (g Br/100 g) | 2.18 |
| Acid no. (mgKOH/g) | 15.25 |
| Carbonyls (% MEK) | 4.95 |
| Alcohols (% $C_7$) | 6.45 |
| Esters (mg KOH/g) | 2.55 |
| Bottoms | |
| Bromine no. (g Br/100 g) | 14.76 |
| Acid no. (mgKOH/g) | 0.47 |
| Carbonyls (% MEK) | 2.70 |
| Alcohols (% $C_7$) | 0.58 |
| Esters (mg KOH/g) | 40.45 |

Generally, in Examples 7 to 9, an olefinic feedstock comprising an unsaturated oligomer mixture was fed below the catalyst bed 14 at a rate between 5-15 kg/h. Hydrogen was fed at a rate of 1-9 $m^3$n/h normal per hour below the catalyst bed. The column pressure was varied between 50-200 kPa(g), which resulted in catalyst bed temperatures ranging from 160° C.-200° C. The conversion of the olefins in the feed stream was 60-99%.

Example 7

The 10 meter 4 inch column was loaded with the same commercially available hydrogenation catalyst as used in Example 5. An oligomer mixture with an olefin content of between 45 and 80 mass % was fed, as an olefinic feedstock, below the catalyst bed at a rate of 15.02 kg/hr. The feed composition is given in Table 7.1.

TABLE 7.1

| Hydrocarbon Feedstock composition and Feed Characterization. | Mass % |
|---|---|
| Feed component | |
| Propane | 0.01 |
| Isobutane | 0.27 |
| 1-butene + Isobutene | 0.54 |
| Butane | 5.62 |
| t-2-Butene | 3.43 |
| c-2-Butene | 2.32 |
| C5 paraffins | 1.31 |
| C5 olefins | 2.57 |
| C6 paraffins | 0.28 |
| C6 olefins | 3.83 |
| C7 and heavier hydrocarbons | 79.83 |
| C4 and lighter hydrocarbons | 6.29 |
| Total | 100 |
| Feed Characterization | |
| Bromine no. (g Br/100 g) | 90.00 |
| Sample 1 RVP | 66 kPa |
| Sample 2 RVP | 65 kPa |

Hydrogen was fed below the catalyst bed at a rate 0.79 of kg/hr. The column pressure was 163 kPa(g) which resulted in catalyst bed temperature of 193° C. The reboiler temperature was 234° C. The reflux flow was maintained at 55 kg/hr. The hydrogenated product was removed as the overhead stream. 14.62 kg of overheads were collected per hour. Excess hydrogen was flared. The conversion of the olefins in the feed stream was 99.9%. The bromine number of the overheads (hydrogenated) product was 0.05.

Example 8

The 10 meter 4 inch column was loaded with the same commercially available hydrogenation catalyst as used in Example 5. The same feedstock as was used in Example 7, was fed below the catalyst bed at a rate of 15.00 kg/hr.

Hydrogen was fed below the catalyst bed at a rate 0.18 of kg/hr. The column pressure was 133 kPa(g) which resulted in catalyst bed temperature of 202° C. The reboiler temperature was 229° C. The reflux flow was maintained at 40 kg/hr. The hydrogenated compounds were removed as the overhead stream. 14.80 kg of overheads were collected per hour. Excess hydrogen was flared. The conversion of the olefins in the feed stream was 39.0%. The bromine number of the overheads (hydrogenated) product was 54.92.

Example 9

The 10 meter 4 inch column was loaded with the same commercially available hydrogenation catalyst as used in Example 5. The same feedstock as was used in Example 7, was fed below the catalyst bed at a rate of 10.02 kg/hr.

Hydrogen was fed below the catalyst bed at a rate 0.33 of kg/hr. The column pressure was 52 kPa(g) which resulted in catalyst bed temperature of 177° C. The reboiler temperature was 214° C. The reflux flow was maintained at 35 kg/hr. The hydrogenated product was removed as the overhead stream. 10.22 kg of overheads were collected per hour. Excess hydrogen was flared. The conversion of the olefins in the feed stream was 99.4%. The bromine number of the overhead (hydrogenated) product was 0.56.

Examples 10-13

Examples 10-13 were performed in identical fashion to Examples 7 to 9, using the same feedstock, catalyst, etc., but having different feedstock feed rates, hydrogen feed rates and other operating parameters. The flow rates, operating parameters, product analyses and results are given in Table 10.1. For completeness, Examples 7 to 9 are included in Table 10.1.

TABLE 10.1

| | | | Period # | | | | | | |
|---|---|---|---|---|---|---|---|---|---|
| | | | 7 | 10 | 11 | 8 | 12 | 13 | 9 |
| FLOW RATES | | | | | | | | | |
| Feed | | | | | | | | | |
| Catpoly | Kg/hr | | 15.02 | 14.99 | 15.01 | 15.00 | 10.00 | 10.00 | 10.02 |
| Hydrogen | Kg/hr | | 0.79 | 0.22 | 0.29 | 0.18 | 0.79 | 0.79 | 0.33 |
| Products | | | | | | | | | |
| Bottoms | Kg/hr | | 0.56 | * | 1.02 | 0.16 | * | 0.30 | * |
| Overheads | Kg/hr | | 14.62 | 15.20 | 14.02 | 14.80 | 10.14 | 9.78 | 10.22 |
| Flare - hydrogen | Kg/hr | | 0.62 | 0.12 | 0.14 | 0.11 | 0.68 | 0.68 | 0.22 |
| OPERATION | | | | | | | | | |
| Column pressure | kPa(g) | | 163 | 136 | 153 | 133 | 56 | 55 | 52 |
| Catalyst bed temperature | ° C. | | 193 | 201 | 200 | 202 | 159 | 164 | 177 |
| Reboiler temperature | ° C. | | 234 | 229 | 230 | 229 | 211 | 215 | 214 |
| Reflux flow | kg/hr | | 55 | 45 | 45 | 40 | 35 | 35 | 35 |
| ANALYSIS | mass % | | | | | | | | |
| Products | | Feed | | | | | | | |
| Overheads | | | | | | | | | |
| Bromine No | gr Br/100 gr | 90.00 | 0.05 | 35.42 | 9.45 | 54.92 | 2.11 | 1.15 | 0.56 |
| RESULTS | | | | | | | | | |
| CONVERSION TO PARAFFINS | % | | | | | | | | |
| Total olefins based on Br No | | | 99.9 | 60.6 | 89.5 | 39.0 | 97.7 | 98.7 | 99.4 |

* In these Examples, the bottoms production was negligible

The Applicant believes that the process according to the invention has, among others, the following advantages:

- Lower operating pressures can be used in the catalytic distillation column 12 compared to fixed bed/trickle bed hydrogenation technologies, to achieve the same conversion/productivity potential resulting in less capital intensive equipment being required.
- Hydrogenation is an exothermic reaction so that substantial amounts of heat of reaction are produced. With the process 10, in situ removal of these substantial amounts of heat of reaction can be achieved. Highly liquid recycles or the use of intercoolers is not required, potentially resulting in process simplifications.
- Due to excellent removal of heat of reaction, i.e. no hot spots, less fouling of the catalyst due to the formation of oligomers, occurs; this results in an extended catalyst life compared to the same catalyst used in a fixed bed hydrogenation reactor.
- Acidity of the feed, which can lead to the formation of heavy components/oligomers, has no negative effect on the catalyst activity as the heavy components are continuously washed from the surfaces of the catalyst particles.

Additionally, the process according to the invention has general advantages over conventional processes for hydrogenating olefinic feedstocks comprising a hydrogenation reactor followed by a distillation column, such as Equilibrium constraints are overcome, as products are continuously removed from the reaction zone, resulting in increased productivity.

Extended catalyst life is expected, due to the removal of products from the catalyst surface as a result of the washing action of the reflux in the catalytic distillation column.

Increased selectivities are expected since high local temperatures, which can lead to by-product formation, are limited.

Strategic location of feed points into the catalytic distillation column can limit the harmful effect of poisons and/or inhibitors in the feedstock.

The process can handle azeotropic systems.

The process has the ability to remove large amounts of heat of reaction while maintaining a stable catalyst temperature as the column temperature is set by the column pressure, provided that the column is operated above the minimum required loading.

The general process scheme can be simplified since the two operations of the known processes are now performed in one vessel.

The heat of reaction is used for separation purposes, resulting in reduced reboiler requirements.

The invention claimed is:

1. A process for hydrogenating an olefin-containing feedstock containing a plurality of different unsaturated olefinic hydrocarbon compounds characterized as having from 60 to 100 mass % unsaturated olefinic hydrocarbon compounds, the process including:

subjecting the olefinic feedstock to bulk hydrogenation by means of catalytic distillation in a catalytic distillation zone containing a hydrogenation catalyst, and in the presence of hydrogen, thereby to hydrogenate from about 30 to about 100% of the unsaturated olefinic hydrocarbon compounds present in the feedstock into their corresponding saturated compounds; and withdrawing the saturated compounds from the catalytic distillation zone;

recovering unhydrogenated olefinic hydrocarbon compounds comprising lightest olefinic hydrocarbon compounds in said feedstock from said hydrogenate; and recovering unhydrogenated olefinic hydrocarbon compounds comprising heaviest olefinic hydrocarbon compounds in said feedstock from said hydrogenate.

2. The process according to claim 1 wherein said feedstock comprises from 80 to 100 mass % unsaturated olefinic hydrocarbon compounds.

3. The process according to claim 1 wherein said bulk hydrogenation is carried out a pressure up to 1500 kPa (g).

4. The process according to claim 3 wherein said bulk hydrogenation is carried out at pressure in the range of 50 to about 200 kPa (g).

5. The process according to claim 1, 2, 3 or 4 wherein said feedstock comprises $C_7$-$C_{13}$ naphtha.

6. The process according to claim 1, 2, 3 or 4 wherein said feedstock comprises oligomers obtained from the oligomerization of $C_3$-$C_7$ unsaturated olefinic hydrocarbons.

7. The process according to claim 1, 2, 3 or 4 wherein said feedstock comprises unsaturated hydrocarbon compounds derived from Fischer-Tropsch reaction.

8. The process according to claim 5 wherein the feedstock comprises $C_7$-$C_{13}$ naphtha feedstock, said bulk hydrogenation is operating at pressure in the range of 100 kPa (g)-200 kPa (g) in a catalyst bed which is at a temperature in the range of about 120° C.-140° C., with a product stream comprising saturated compounds being removed as a bottoms stream and an overheads stream comprising unreacted unsaturated olefinic hydrocarbon compounds being lighter compounds.

9. The process according to claim 3 wherein the feedstock comprises unsaturated olefinic oligomers derived from $C_3$-$C_7$ olefins, said bulk hydrogenation is operating at a pressure in the range of about 50 kPa (g)-200 kPa (g) in a catalyst bed which is at a temperature is in the range of about 160° C.-200° C., with a product stream comprising saturated hydrocarbon compounds being removed as an overheads stream and a bottoms stream comprising unreacted unsaturated hydrocarbon compounds being heavier compounds.

* * * * *